US007323226B2

(12) United States Patent
Kittle et al.

(10) Patent No.: US 7,323,226 B2
(45) **Date of Patent: *Jan. 29, 2008**

(54) TRIBOSTATIC FLUIDISED BED POWDER COATING PROCESS

(75) Inventors: Kevin Jeffrey Kittle, Durham (GB); Michele Falcone, Como (IT)

(73) Assignee: AKZO Nobel Coatings International B.V., Arnhem (NL)

( * ) Notice: Subject to any disclaimer, the term of this patent is extended or adjusted under 35 U.S.C. 154(b) by 0 days.

This patent is subject to a terminal disclaimer.

(21) Appl. No.: 10/534,059

(22) PCT Filed: Dec. 11, 2003

(86) PCT No.: PCT/EP03/14167

§ 371 (c)(1),
(2), (4) Date: Oct. 6, 2005

(87) PCT Pub. No.: WO2004/052558

PCT Pub. Date: Jun. 24, 2004

(65) Prior Publication Data

US 2006/0062929 A1 Mar. 23, 2006

(30) Foreign Application Priority Data

Dec. 12, 2002 (GB) ..... 0229003.9

(51) Int. Cl.
*B05D 1/04* (2006.01)

(52) U.S. Cl. ..... 427/459; 427/460; 427/461

(58) Field of Classification Search ..... 427/459, 427/460, 461

See application file for complete search history.

(56) References Cited

U.S. PATENT DOCUMENTS

| | | | | |
|---|---|---|---|---|
| 3,248,253 | A | 4/1966 | Barford | |
| 3,396,699 | A | 8/1968 | Beebe et al. | |
| 3,670,699 | A | 6/1972 | Sargent | |
| 3,690,298 | A | 9/1972 | Venturi | |
| 3,817,211 | A | 6/1974 | Brown et al. | |
| 3,871,328 | A | 3/1975 | English | |
| 5,714,007 | A * | 2/1998 | Pletcher et al. | 118/629 |
| 5,877,231 | A * | 3/1999 | Biller et al. | 522/93 |
| 6,280,798 | B1 | 8/2001 | Ring et al. | |
| 6,506,455 | B1 | 1/2003 | Bru et al. | |

FOREIGN PATENT DOCUMENTS

| | | |
|---|---|---|
| DE | 234 263 A | 3/1986 |
| FR | 2 720 959 A1 | 12/1995 |
| WO | WO 94/11446 | 5/1994 |
| WO | WO 99/30838 | 6/1999 |
| WO | WO 00/01775 | 1/2000 |
| WO | WO 00/76677 A | 12/2000 |
| WO | WO 01/59017 | 8/2001 |
| WO | WO 02/098577 A1 | 12/2002 |

* cited by examiner

OTHER PUBLICATIONS

Liberto, N.P. (Ed.), Powder Coating The Complete Finisher's Handbook, pp. 88-89, 1994.

*Primary Examiner*—Fred J. Parker
(74) *Attorney, Agent, or Firm*—Kenyon & Kenyon LLP

(57) ABSTRACT

A process for forming a coating on a substrate, including the steps of effecting tribostatic charging of a body of powder by establishing a fluidised-bed of the body of powder in a fluidising chamber at least a part of which is conductive, applying a voltage to the conductive part of the fluidising chamber, immersing a substrate which is electrically non-conductive or poorly conductive, either electrically isolated or earthed, wholly or partly in the fluidised bed, withdrawing the substrate from the fluidised-bed and forming adherent particles of the powder into a continuous coating over at least part of the substrate.

47 Claims, 3 Drawing Sheets

TRIBOSTATIC FLUIDISED BED POWDER COATING PROCESS

Figure 1:
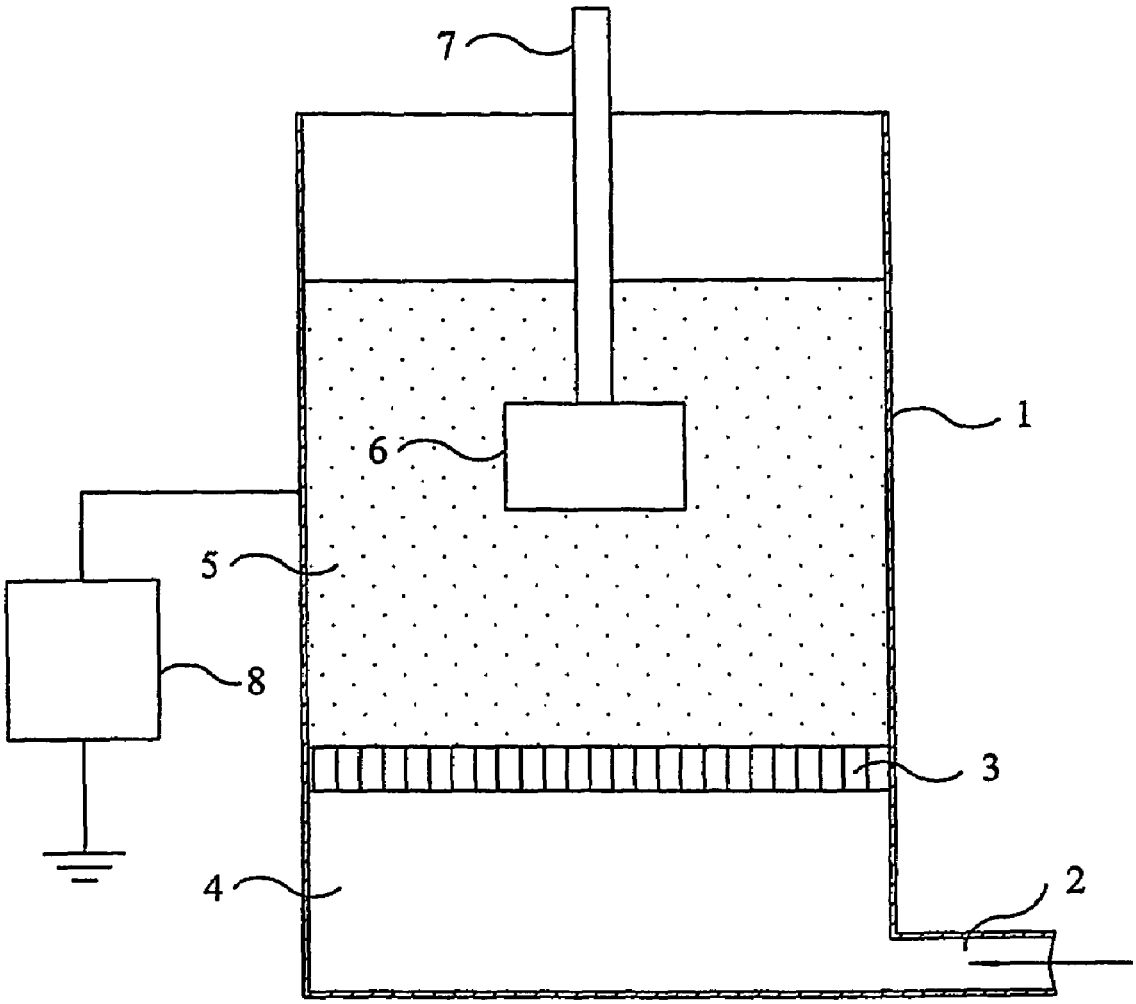

The invention relates to a process for the application of powder coating compositions to substrates.

Powder coatings are solid compositions which are usually applied by an electrostatic application process in which the powder coating particles are electrostatically charged and caused to adhere to a substrate which is usually metallic and electrically earthed. The charging of the powder coating particles is usually achieved by interaction of the particles with ionised air (corona charging) or by friction (triboelectric, tribostatic or "tribo" charging) employing a spray gun. The charged particles are transported in air towards the substrate and their final deposition is influenced, inter alia, by the electric field lines that are generated between the spray gun and the substrate.

A disadvantage of the corona charging process is that there are difficulties in coating substrates having complicated shapes, especially substrates having recessed portions, resulting from restricted access of the electric field lines into recessed locations in the substrate (the Faraday cage effect). The Faraday cage effect is less evident in the case of the tribostatic charging process but that process has other drawbacks.

As an alternative to electrostatic spray processes, powder coating compositions may be applied by processes in which the substrate is preheated (typically to 200° C.-400° C.) and dipped into a fluidised-bed of the powder coating composition. The powder particles that come into contact with the preheated substrate melt and adhere to the surface of the substrate. In the case of thermosetting powder coating compositions, the initially-coated substrate may be subjected to further heating to complete the curing of the applied coating. Such post-heating may not be necessary in the case of thermoplastic powder coating compositions.

Fluidised-bed processes eliminate the Faraday cage effect, thereby enabling recessed portions in the substrate workpiece to be coated, and are attractive in other respects, but are known to have the disadvantage that the applied coatings are substantially thicker than those obtainable by electrostatic coating processes.

Another alternative application technique for powder coating compositions is the so-called electrostatic fluidised-bed process, in which air is ionised by means of charging electrodes arranged in a fluidising chamber or, more usually, in a plenum chamber lying below a porous air-distribution membrane. The ionised air charges the powder particles, which acquire an overall upwards motion as a result of electrostatic repulsion of identically charged particles. The effect is that a cloud of charged powder particles is formed above the surface of the fluidised-bed. The substrate is usually earthed and is introduced into the cloud of powder particles some of which are deposited on the substrate surface by electrostatic attraction. No preheating of the substrate is required in the electrostatic fluidised-bed process.

The electrostatic fluidised-bed process is especially suitable for coating small articles, because the rate of deposition of the powder particles is reduced as the article is moved away from the surface of the charged bed. Also, as in the case of the traditional fluidised-bed process, the powder is confined to an enclosure and there is no need to provide equipment for the recycling and re-blending of over-spray that is not deposited on the substrate. As in the case of the corona-charging electrostatic process, however, there is a strong electric field between the charging electrodes and the substrate and, as a result, the Faraday cage effect operates to a certain extent and leads to poor deposition of powder particles into recessed locations on the substrate.

The present invention provides a process for forming a coating on a substrate, including the steps of:

establishing a fluidised-bed of a powder coating composition, thereby effecting tribostatic charging of the powder coating composition, the fluidised-bed including a fluidising chamber at least a part of which is conductive, applying a voltage to the conductive part of the fluidising chamber, immersing a substrate which is either electrically non-conductive or poorly conductive wholly or partly in the fluidised bed, whereby tribostatically charged particles of the powder coating composition adhere to the substrate, the substrate being either electrically isolated or earthed, withdrawing the substrate from the fluidised-bed and forming the adherent particles into a continuous coating over at least part of the substrate, the process being conducted without ionisation or corona effects in the fluidised bed.

The substrate may comprise medium density fibre-board (MDF) or a plastics material or another non-conductive or poorly conductive material and may, in principle, be of any desired shape and size.

In addition to MDF, wood, wood products, plastics materials, plastics materials including electrically conductive additives, polyamide and highly insulating plastics materials, for example, polycarbonate provide suitable substrates.

Substrates having a surface resistance of between $10^3$ ohms/square, say, and $10^{11}$ ohms/square, say, may be considered as poorly conductive while substrates having a surface resistance above $10^{11}$ ohms/square, say, may be considered as non-conductive.

An MDF substrate may have a surface resistance of the order of between $10^3$ ohms/square and $10^{11}$ ohms/square depending on its moisture content, so that a surface resistance of the order of $10^3$ ohms/square will correspond to a higher moisture content than does a surface resistance of the order of $10^{11}$ ohms/square.

Wood and wood products may be expected to have a surface resistance of the order of between $10^3$ ohms/square and $10^{11}$ ohms/square depending on the type of wood and its moisture content.

Plastics materials including electrically conductive additives and various plastics materials without electrically conductive additives may have a surface resistance of the order of between $10^3$ and $10^{11}$ ohms/square, that is to say, within the poorly conductive range, depending on the material and, where included, the additive or additives.

Highly insulating plastics materials including, for example, polyamide and polycarbonate may be expected to have a surface resistance of an order of above $10^{11}$ ohms/square, that is to say, in the non-conductive range.

In addition, poorly conductive substrates may be classified into a lower range of surface resistance of the order of between $10^3$ and $10^5$ ohms/square and an upper range of surface resistance starting slightly above $10^5$ and extending to $10^{11}$ ohms/square. Materials having a surface resistance above $10^{11}$ ohms/square can be considered as "insulating".

Substrates which may be coated by the process of the invention are, of course, not restricted to polymers.

The surface resistance of the substrate may be of the order of at least $10^3$ ohms/square, for example:

of the order of between $10^3$ and $10^5$ ohms/square.

of the order of at least $10^5$ ohms/square.

of the order of between $10^5$ and $10^{11}$ ohms/square.

The surface resistance of an insulating substrate may be of the order of at least $10^{11}$ ohms/square.

The surface resistance values given above are as measured by ASTMS Standard D257-93 with 2 kV applied.

Advantageously, the substrate is chemically or mechanically cleaned prior to application of the composition.

In the process of the present invention, particles of the powder coating composition adhere to the substrate as a result of the frictional charging (triboelectric, tribostatic or "tribo" charging) of the particles as they rub against one another in circulating in the fluidised bed.

The process is effective to powder coat substrates that are poorly conductive and highly non-conductive. Poorly conductive substrates can be coated when electrically isolated and when earthed and highly non-conductive substrates are inherently isolated by virtue of their non-conductivity.

The process of the present invention is conducted without ionisation or corona effects in the fluidised bed.

The voltage applied to the fluidised-bed chamber is sufficient to cause the coating of the substrate by the frictionally charged powder coating particles while resulting in a maximum potential gradient that is insufficient to produce either ionisation or corona effects in the fluidised bed. Air at atmospheric pressure usually serves as the gas in the fluidised bed but other gases may be used, for example, nitrogen or helium.

As compared with the electrostatic fluidised-bed process in which a substantial electric field is generated between charging electrodes and the substrate, the process of the present invention offers the possibility of achieving good coating of substrates including fibrous material without any tendency for the fibrous material to stand on end as might occur in a substantial electric field.

As compared with traditional fluidised-bed application processes, the process of the invention offers the possibility of coating materials including MDF and plastics for which heating to temperatures of 200 to 400° C. is undesirable. Also, the process achieves thin coatings on MDF and plastics materials in a controlled manner since inter-particle charging becomes more effective as particle sizes are reduced.

Improvements in efficiency as particle sizes are reduced stands in contrast with the powder coating process using a triboelectric gun where efficiency falls as particle sizes are reduced.

The uniformity of the coating may be improved by shaking or vibrating the substrate in order to remove loose particles Conversion of the adherent particles into a continuous coating (including, where appropriate, curing of the applied composition) may be effected by heat treatment and/or by radiant energy, notably infra-red, ultra-violet or electron beam radiation. Compared with traditional fluidised-bed application technology, pre-heating of the substrate is not an essential step in the process of the invention and, preferably, there is no preheating of the substrate prior to immersion in the fluidised bed.

Since the voltage applied to the fluidising chamber is insufficient to produce either ionisation or corona effects in the fluidised bed, the fluidising chamber is unlikely to draw any electrical current when the substrate is electrically isolated and, consequently, is unlikely to draw any electrical power when the substrate is electrically isolated. The current drawn is expected to be less than 1 mA when the substrate is electrically earthed.

Where the substrate comprises a plastics material which shows surface conductivity when at an elevated temperature, the process, preferably, includes the step of heating the plastics material to a temperature below its melting point and below the glass transition temperature of the powder coating composition before immersing the substrate in the fluidised bed.

Where the substrate comprises a plastics material which shows no substantial surface conductivity even at an elevated temperature, the process, preferably, includes the step of pre-charging the substrate before immersing it in the fluidised bed.

Preferably, the process includes the step of equalising the charge on the pre-charged substrate at the point of immersion and then immersing the substrate in the fluidised bed.

The charge may be equalised by heating the substrate to a temperature below its melting point or by introducing surface moisture on the substrate or both.

The voltage applied to the fluidising chamber in the process of the present invention is, preferably, a direct voltage, either positive or negative, but the use of an alternating voltage is possible by, say, applying the voltage intermittently at times when it is positive or at times when it is negative. The applied voltage may vary within wide limits according, inter alia, to the size of the fluidised bed, the size and complexity of the substrate and the film thickness desired. On this basis, the applied voltage will in general be in the range of from 10 volts to 100 kilovolts, more usually from 100 volts to 60 kilovolts, preferably from 100 volts to 30 kilovolts, more especially from 100 volts to 10 kilovolts, either positive or negative. The voltage ranges include 10 volts to 100 volts, 100 volts to 5 kilovolts, 5 kilovolts to 60 kilovolts, 15 kilovolts to 35 kilovolts, 5 kilovolts to 30 kilovolts; 30 kilovolts to 60 kilovolts may also be satisfactory.

A direct voltage may be applied to the fluidising chamber continuously or intermittently and the polarity of the applied voltage may be changed during coating. With intermittent application of the voltage, the fluidising chamber may be electrified before the substrate is immersed in the fluidised bed and not disconnected until after the substrate has been removed from the bed. Alternatively, the voltage may be applied only after the substrate has been immersed in the fluidised-bed. Optionally, the voltage may be disconnected before the substrate is withdrawn from the fluidised-bed. The magnitude of the applied voltage may be varied during coating.

In order to exclude ionisation and corona conditions, the maximum potential gradient existing in the fluidised bed is below the ionisation potential for the air or other fluidising gas. Factors determining the maximum potential gradient include the applied voltage and the spacing between the fluidising chamber and the substrate and other elements of the apparatus.

For air at atmospheric pressure, the ionisation potential gradient is 30 kV/cm, and accordingly the maximum potential gradient using air as fluidising gas at atmospheric pressure should be below 30 kV/cm. A similar maximum potential gradient would also be suitable for use with nitrogen or helium as fluidising gas.

Based on these considerations, the maximum potential gradient existing in the fluidised bed may be 29 kV/cm, 27.5, 25, 20, 15, 10, 5 or 0.05 kV/cm.

The minimum potential gradient will in general be at least 0.01 kV/cm or at least 0.05 kV/cm.

Preferably, the substrate is wholly immersed within the fluidised bed during the coating process.

As is stated above, in the process according to the invention, the charging of the powder particles is effected by friction between particles in the fluidised-bed. The friction between the particles in the fluidised-bed leads to bipolar charging of the particles, that is to say, a proportion of the particles will acquire a negative charge and a proportion will acquire a positive charge. The presence of both positively and negatively charged particles in the fluidised-bed might appear to be a disadvantage, especially when a direct voltage is applied to the fluidising chamber, but the process of the invention is capable of accommodating the bipolar charging of the particles.

In the case in which a direct voltage of a given polarity is applied to the fluidising chamber, electrostatic forces tend to attract powder coating particles of predominantly one polarity onto the substrate. The resulting removal of positively and negatively charged particles at different rates might be expected to lead to a progressive reduction in the proportion of particles of a particular polarity in the body of powder but it is found that, in practice, the remaining powder particles adjust their relative polarities as depletion progresses and charge-balance is maintained.

The preferred period of immersion of the substrate with the fluidising chamber in a charged condition will depend on the size and geometrical complexity of the substrate, the film thickness required, and the magnitude of the applied voltage, being generally in the range of from 10 milliseconds to 10, 20 or 30 minutes, usually 500 milliseconds to 5 minutes, more especially from 1 second to 3 minutes.

Preferably, the substrate is moved in a regular or intermittent manner during its period of immersion in the fluidised bed. The motion may, for example, be linear, rotary and/or oscillatory. As is indicated above, the substrate may, additionally, be shaken or subjected to vibration in order to remove particles adhering only loosely to it. As an alternative to a single immersion, the substrate may be repeatedly immersed and withdrawn until the desired total period of immersion has been achieved.

The pressure of the fluidising gas (normally air) will depend on the bulk of the powder to be fluidised, the fluidity of the powder, the dimensions of the fluidised bed, and the pressure difference across the porous membrane.

The particle size distribution of the powder coating composition may be in the range of from 0 to 150 microns, generally up to 120 microns, with a mean particle size in the range of from 15 to 75 microns, preferably at least 20 to 25 microns, advantageously not exceeding 50 microns, more especially 20 to 45 microns.

Finer size distributions may be preferred, especially where relatively thin applied films are required, for example, compositions in which one or more of the following criteria is satisfied:

a) 95-100% by volume <50 μm
b) 90-100% by volume <40 μm
c) 45-100% by volume <20 μm
d) 5-100% by volume <10 μm preferably 10-70% by volume <10 μm
e) 1-80% by volume <5 μm preferably 340% by volume <5 μm
f) $d(v)_{50}$ in the range 1.3-32 μm preferably 8-24 μm Powder coating compositions wherein the mean powder-particle size is of the order of 5.5 μm and wherein substantially all of the powder particles are no larger than 10 μm, are effective to minimize the amount of heat applied to the substrate at the final step of the coating process.

Alternatively, a powder coating composition that is a low-bake and cure composition permits the final step of the powder coating process to be accomplished with minimal heating.

The provision of a low-bake powder coating composition permits the use of a mean particle size of the order of 35 μm.

$D(v)_{50}$ is the median particle size of the composition. More generally, the volume percentile $d(v)_x$ is the percentage of the total volume of the particles that lies below the stated particle size d. Such data may be obtained using the Mastersizer X laser light-scattering device manufactured by Malvern instruments. If required, data relating to the particle size distribution of the deposited material (before bake/cure) can be obtained by scraping the adhering deposit off the substrate and into the Mastersizer.

The thickness of the applied coating may be in the range of from 5 to 500 microns or 5 to 200 microns or 5 to 150 microns, more especially from 10 to 150 microns, for example from 20 to 100 microns, 20 to 50 microns, 25 to 45 microns, 50 to 60 microns, 60 to 80 microns or 80 to 100 microns or 50 to 150 microns. The principal factor affecting the thickness of the coating is the applied voltage, but the duration of the period of immersion with the fluidising chamber in a charged condition and fluidising air pressure also influence the result.

In general, the coating process of the invention may be characterised by one or more of the following features:

(i) The coating process is three dimensional and capable of penetrating recesses.

(ii) The applied voltage and the spacing between the substrate and the fluidising chamber are selected so that the maximum potential gradient is below the ionisation potential gradient for the air or other fluidising gas. There are accordingly substantially no ionisation or corona effects.

(iii) The thickness of the powder coating increases as the voltage applied to the fluidising chamber increases. The increase in thickness is achievable without loss of quality up to a point but a progressive loss of smoothness is eventually seen.

(iv) Coating is achievable at room temperature.

(v) Uniform coating on the substrate is achievable irrespective of whether the coating is in a recess, on a projection or on a flat surface of the substrate.

(vi) Smooth coated edges are obtainable.

(vii) Good quality powder coating is achievable in terms of smoothness and the absence of pitting or lumpiness.

(viii) As compared with a fluidised-bed triboelectric process in which a voltage is applied to the substrate, more extensive and consistent coverage is achievable, and good coverage can be achieved more quickly.

(ix) MDF acquires some surface moisture under normal storage conditions and highly satisfactory coating is achieved for MDF including a nominal amount of surface moisture.

(x) There is no tendency for the ends of fibres of MDF to stand up.

(xi) There is no tendency for a pattern on one side of a substrate to be reproduced in the powder on the opposite side of the substrate.

The process is effective to powder coat a plastics substrate which includes an electrically conductive additive, in particular, polyamide with a conductive additive.

The process is also effective to powder coat a plastics substrate which does not include an electrically conductive additive. The substrate may be heated in order to make it conductive. During heating the temperature remains below the melting point of the substrate and glass transition temperature of the powder coating.

The above observations, including those for MDF, apply to plastics substrates, except that there are no fibres and there is no requirement for moisture.

In the coating of the plastics substrates, referred to above, the substrate is, preferably, earthed although it may be electrically isolated, that is, without an electrical connection (substrate electrically "floating", that is, its electrical potential is indeterminate).

The spacing between the substrate and the fluidising chamber is about the same as for the fluidised-bed triboelectric process in which a voltage is applied to the substrate so potential gradients are comparable to that process, that is, well below the ionisation potential for the fluid (most usually air) used in the apparatus.

A powder coating composition according to the invention may contain a single film-forming powder component comprising one or more film-forming resins or may comprise a mixture of two or more such components.

The film-forming resin (polymer) acts as a binder, having the capability of wetting pigments and providing cohesive strength between pigment particles and of wetting or binding to the substrate, and melts and flows in the curing/stoving process after application to the substrate to form a homogeneous film.

The or each powder coating component of a composition of the invention will in general be a thermosetting system, although thermoplastic systems (based, for example, on polyamides) can in principle be used instead.

When a thermosetting resin is used, the solid polymeric binder system generally includes a solid curing agent for the thermosetting resin; alternatively two co-reactive film-forming thermosetting resins may be used.

The film-forming polymer used in the manufacture of the or each component of a thermosetting powder coating composition according to the invention may be one or more selected from carboxy-functional polyester resins, hydroxy-functional polyester resins, epoxy resins, and functional acrylic resins.

A powder coating component of the composition can, for example, be based on a solid polymeric binder system comprising a carboxy-functional polyester film-forming resin used with a polyepoxide curing agent. Such carboxy-functional polyester systems are currently the most widely used powder coatings materials. The polyester generally has an acid value in the range 10-100, a number average molecular weight Mn of 1,500 to 10,000 and a glass transition temperature Tg of from 30° C. to 85° C., preferably at least 40° C. The poly-epoxide can, for example, be a low molecular weight epoxy compound such as triglycidyl isocyanurate (TGIC), a compound such as diglycidyl terephthalate condensed glycidyl ether of bisphenol A or a light-stable epoxy resin. Such a carboxy-functional polyester film-forming resin can alternatively be used with a bis(beta-hydroxyalkylamide) curing agent such as tetrakis(2-hydroxyethyl) adipamide.

Alternatively, a hydroxy-functional polyester can be used with a blocked isocyanate-functional curing agent or an amine-formaldehyde condensate such as, for example, a melamine resin, a urea-formaldehye resin or a glycol ural formaldehye resin, for example the material "Powderlink 1174" supplied by the Cyanamid Company, or hexahydroxymethyl melamine. A blocked isocyanate curing agent for a hydroxy-functional polyester may, for example, be internally blocked, such as the uretdione type, or may be of the caprolactam-blocked type, for example isophorone diisocyanate.

As a further possibility, an epoxy resin can be used with an amine-functional curing agent such as, for example, dicyandiamide. Instead of an amine-functional curing agent for an epoxy resin, a phenolic material may be used, preferably a material formed by reaction of epichlorohydrin with an excess of bisphenol A (that is to say, a polyphenol made by adducting bisphenol A and an epoxy resin). A functional acrylic resin, for example a carboxy-, hydroxy- or epoxy-functional resin can be used with an appropriate curing agent.

Mixtures of film-forming polymers can be used, for example a carboxy-functional polyester can be used with a carboxy-functional acrylic resin and a curing agent such as a bis(beta-hydroxyalkylamide) which serves to cure both polymers. As further possibilities, for mixed binder systems, a carboxy-, hydroxy- or epoxy-functional acrylic resin may be used with an epoxy resin or a polyester resin (carboxy- or hydroxy-functional). Such resin combinations may be selected so as to be co-curing, for example a carboxy-functional acrylic resin co-cured with an epoxy resin, or a carboxy-functional polyester co-cured with a glycidyl-functional acrylic resin. More usually, however, such mixed binder systems are formulated so as to be cured with a single curing agent (for example, use of a blocked isocyanate to cure a hydroxy-functional acrylic resin and a hydroxy-functional polyester). Another preferred formulation involves the use of a different curing agent for each binder of a mixture of two polymeric binders (for example, an amine-cured epoxy resin used in conjunction with a blocked isocyanate-cured hydroxy-functional acrylic resin).

Other film-forming polymers which may be mentioned include functional fluoropolymers, functional fluorochloropolymers and functional fluoroacrylic polymers, each of which may be hydroxy-functional or carboxy-functional, and may be used as the sole film-forming polymer or in conjunction with one or more functional acrylic, polyester and/or epoxy resins, with appropriate curing agents for the functional polymers.

Other curing agents which may be mentioned include epoxy phenol novolacs and epoxy cresol novolacs; isocyanate curing agents blocked with oximes, such as isopherone diisocyanate blocked with methyl ethyl ketoxime, tetramethylene xylene diisocyanate blocked with acetone oxime, and Desmodur W (dicyclohexylmethane diisocyanate curing agent) blocked with methyl ethyl ketoxime; light-stable epoxy resins such as "Santolink LSE 120" supplied by Monsanto; and alicyclic poly-epoxides such as "EHPE-3150" supplied by Daicel.

A powder coating composition for use according to the invention may be free from added colouring agents, but usually contains one or more such agents (pigments or dyes). Examples of pigments which can be used are inorganic pigments such as titanium dioxide, red and yellow iron oxides, chrome pigments and carbon black and organic pigments such as, for example, phthalocyanine, azo, anthraquinone, thioindigo, isodibenzanthrone, triphendioxane and quinacridone pigments, vat dye pigments and lakes of acid, basic and mordant dyestuffs. Dyes can be used instead of or as well as pigments.

The composition of the invention may also include one or more extenders or fillers, which may be used inter alia to assist opacity, whilst minimising costs, or more generally as a diluent.

The following ranges should be mentioned for the total pigment/filler/extender content of a powder coating composition according to the invention (disregarding post-blend additives):

0% to 55% by weight,

0% to 50% by weight,

10% to 50% by weight,

0% to 45% by weight, and

25% to 45% by weight

Of the total pigment/filler/extender content, the pigment content will generally be ≦40% by weight of the total composition (disregarding post-blend additives) but proportions up to 45% or even 50% by weight may also be used. Usually a pigment content of 25 to 30 or 35% is used, although in the case of dark colours opacity can be obtained with <10% by weight of pigment.

The composition of the invention may also include one or more performance additives, for example, a flow-promoting agent, a plasticiser, a stabiliser, e.g. against UV degradation, or an anti-gassing agent, such as benzoin, or two or more such additives may be used. The following ranges should be mentioned for the total performance additive content of a powder coating composition according to the invention (disregarding post-blend additives):

0% to 5% by weight,

0% to 3% by weight, and

1% to 2% by weight.

In general, colouring agents, fillers/extenders and performance additives as described above will not be incorporated by post-blending, but will be incorporated before and/or during the extrusion or other homogenisation process.

After application of the powder coating composition to a substrate, conversion of the resulting adherent particles into a continuous coating (including, where appropriate, curing of the applied composition) may be effected by heat treatment and/or by radiant energy, notably infra-red, ultra-violet or electron beam radiation.

The powder is usually cured on the substrate by the application of heat (the process of stoving); the powder particles melt and flow and a film is formed. The curing times and temperatures are interdependent in accordance with the composition formulation that is used, and the following typical ranges may be mentioned:

| Temperature/° C. | Time |
|---|---|
| 280 to 100* | 10 s to 40 min |
| 250 to 150 | 15 s to 30 min |
| 220 to 160 | 5 min to 20 min |

*Temperatures down to 90° C. may be used for some resins, especially certain epoxy resins.

The powder coating composition may incorporate, by post-blending, one or more fluidity-assisting additives, for example, those disclosed in WO 94/11446, and especially the preferred additive combination disclosed in that Specification, comprising aluminium oxide and aluminium hydroxide, typically used in proportions in the range of from 1:99 to 99:1 by weight, advantageously from 10:90 to 90:10, preferably from 20:80 to 80:20 or 30:70 to 70:30, for example, from 45:55 to 55:45. Other combinations of the inorganic materials disclosed as post-blended additives in WO 94/11446 may in principle also be used in the practice of the present invention, for example, combinations including silica. Aluminium oxide and silica may in addition be mentioned as materials which can be used singly as post-blended additives. Mention may also be made of the use of wax-coated silica as a post-blended additive as disclosed in WO 00/01775, including combinations thereof with aluminium oxide and/or aluminium hydroxide. Use may also be made of a PTFE modified wax or other wax material, for example, as disclosed in WO 01/59017.

The total content of post-blended additive(s) incorporated with the powder coating composition will in general be in the range of from 0.01% to 10% by weight, preferably at least 0.1% by weight and not exceeding 1.0% by weight (based on the total weight of the composition without the additive(s)). Combinations of aluminium oxide and aluminium hydroxide (and similar additives) are advantageously used in amounts in the range of from 0.25 to 0.75% by weight, preferably 0.45 to 0.55%, based on the weight of the composition without the additives. Amounts up to 1% or 2% by weight may be used, but problems can arise if too much is used, for example, bit formation and decreased transfer efficiency.

The term "post-blended" in relation to any additive means that the additive has been incorporated after the extrusion or other homogenisation process used in the manufacture of the powder coating composition.

Post-blending of an additive may be achieved, for example, by any of the following dry-blending methods:

a) tumbling into the chip before milling;

b) injection at the mill;

c) introduction at the stage of sieving after milling;

d) post-production blending in a "tumbler" or other suitable mixing device; or e) introduction into the fluidised bed.

Figure 2A:
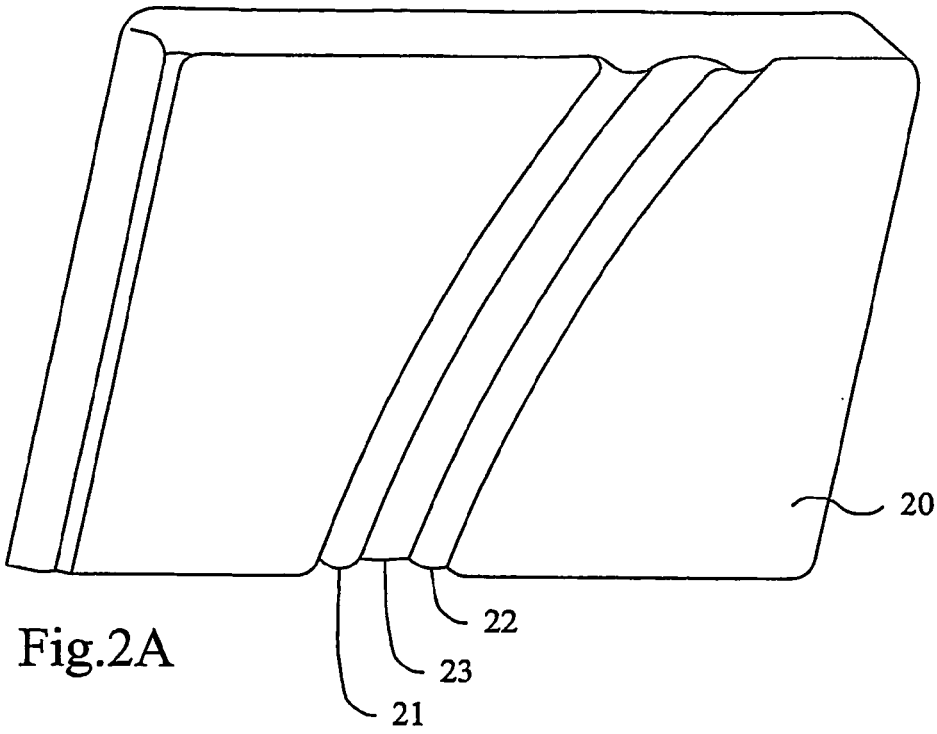
Figure 2B:
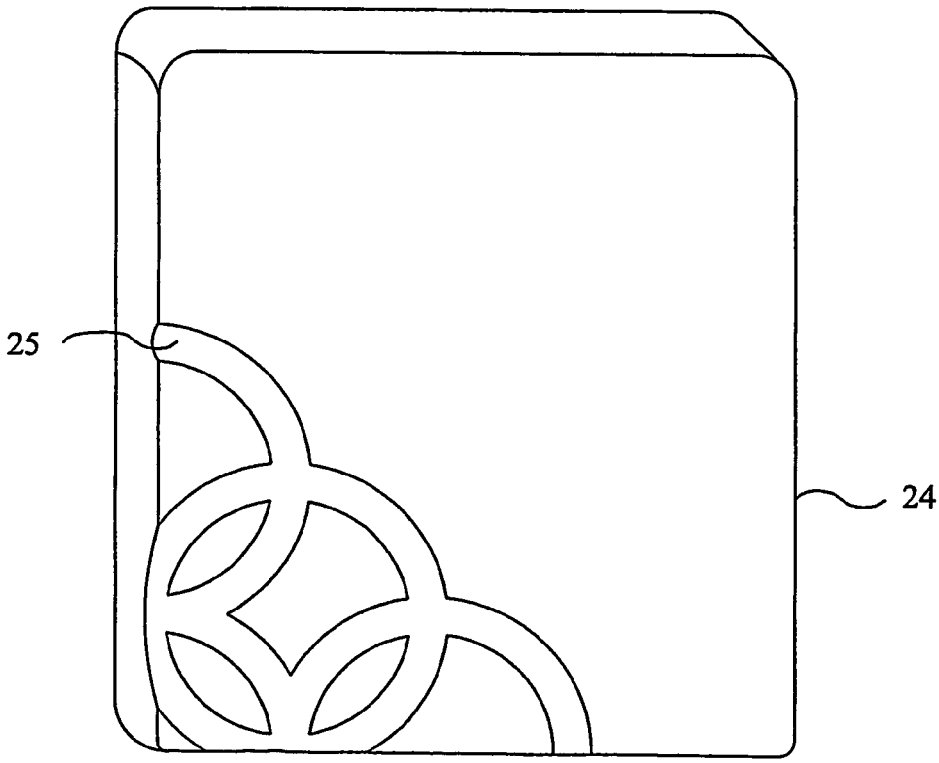
Figure 3A:
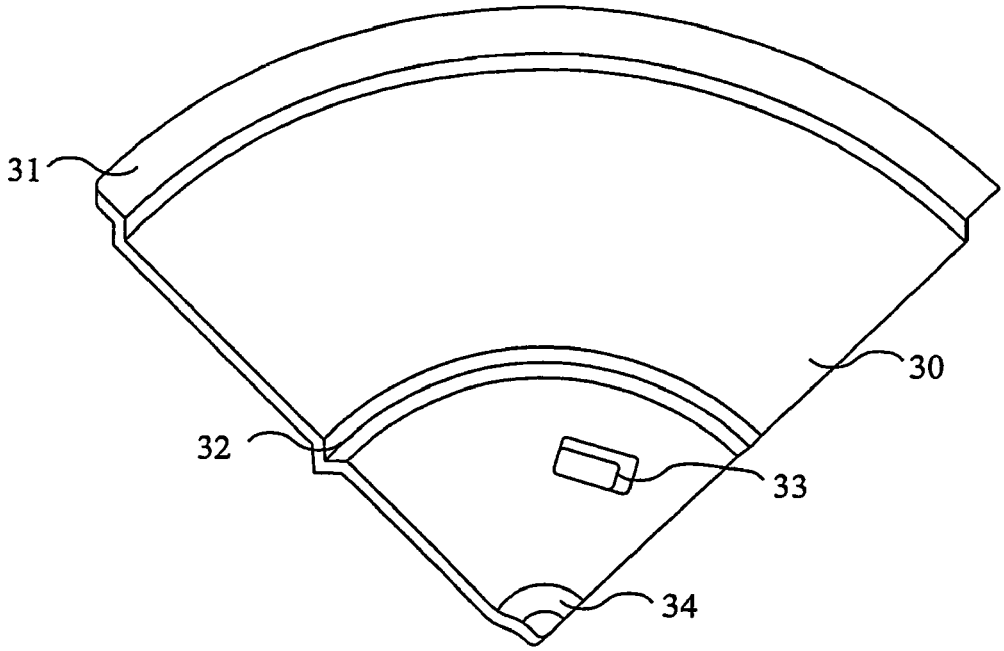
Figure 3B:
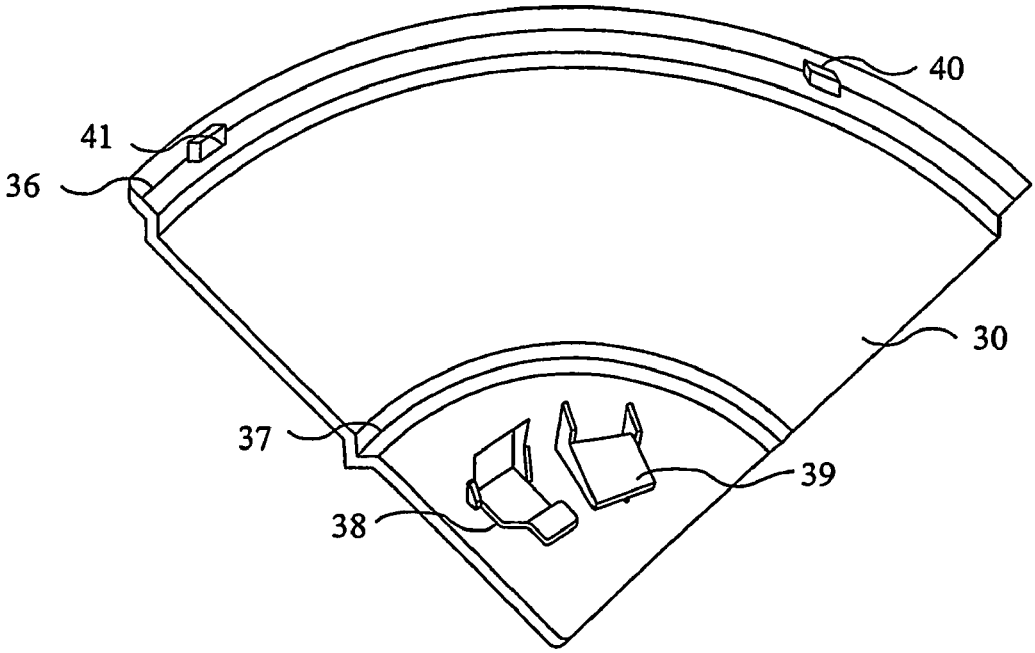

A general form of fluidised-bed triboelectric powder coating apparatus suitable for carrying out a process in accordance with the invention and several forms of process in accordance with the invention will now be described, by way of example only, with reference to the accompanying drawings, in which:

FIG. 1 shows the general form of fluidised-bed triboelectric powder coating apparatus in diagrammatic section, FIGS. 2A and 2B are perspective representations of first and second MDF substrates as used in Example 1 and FIGS. 3A and 3B are perspective views of a plastics substrate, as used in Example 3, which includes an electrically conductive additive making the substrate electrically poorly conductive.

Referring to FIG. 1 of the accompanying drawings, the fluidised-bed triboelectric powder coating apparatus includes a fluidising chamber (1) having an air inlet (2) at its base and a porous air distribution membrane (3) disposed transversely so as to divide the chamber into a lower plenum (4) and an upper fluidising compartment (5).

In operation, a substrate (6) having an insulated support (7), preferably a rigid support, is immersed in a fluidised bed of a powder coating composition established in the fluidising compartment (5) by means of an upwardly-flowing stream of air introduced from the plenum (4) through the porous membrane (3).

For at least part of the period of immersion, a direct voltage is applied to the fluidising chamber (1) by means of a variable voltage source (8). The particles of the powder coating composition become electrically charged as a result of triboelectric action among the particles. As shown, the substrate (6) has no electrical connection (electrically "floating"). An electrically non-conductive substrate, inevitably, has no electrical connection but a poorly conductive substrate may be either earthed by a suitable electrical connection or provided with no electrical connection. Triboelectrically charged particles of the powder coating composition adhere to the substrate (6). There are no ionisation or corona effects, the voltage supplied by the voltage source (8) being kept below the level required to generate such effects.

The substrate (6) may be moved in a regular oscillatory manner during the coating process by means not shown in FIG. 1. Alternatively, the substrate may be advanced through the bed either intermittently or continuously during immersion, or may be repeatedly immersed and withdrawn until a desired total period of immersion has been achieved. There is also the possibility of keeping the substrate still and moving the powder by vibrating the bed or stirring the bed with a propeller mixer.

After the desired period of immersion the substrate is withdrawn from the fluidised bed and is heated so as to melt and fuse the adhering particles of the powder coating composition and complete the coating.

The voltage source (8) is mains-powered and the output voltage is measured relative to mains earth potential.

The following Examples illustrate the process of the invention, and were carried out using apparatus as shown in FIG. 1 with a fluidisation unit supplied by the Nordson Corporation having a generally cylindrical chamber (1) of height 25 cm and diameter 15 cm.

In the Examples, the substrate (6) was mounted on an insulating support (7) in the form of a rod of length 300 mm. The substrate was positioned centrally within the fluidising unit, giving rise to a maximum potential gradient that is expected to be no more than 3 kV/cm when a voltage of 3 kV is applied to the fluidising chamber (1). That is, satisfactory results are obtained for potential gradients well below the ionisation potential which is 30 kV/cm for air. It will be evident that the substrate would need to be much closer than it is to the wall of the fluidising unit in order for the maximum potential gradient to be 30 kV/cm when a voltage of 3 kV is applied to the fluidising chamber. The maximum potential gradient when the voltage used is 0.5 kV, is estimated at 0.13 kV/cm, and at a voltage of 0.2 kV the estimated maximum potential gradient is about 0.05 kV/cm. Allowing for the oscillation or the vibration of the substrate, it is expected that satisfactory results would be obtained in conditions providing maximum potential gradients in the range 0.05 kV/cm to 1 kV/cm, probably 0.05 kV/cm to 5 kV/cm and, possibly, 0.05 kV/cm to 10 kV/cm.

All dip times reported in the Examples are in seconds.

EXAMPLE 1

Referring to FIG. 2A of the accompanying drawings, a first substrate 20 used in Example 1 is a block of medium density fibreboard (MDF) which is rectangular in form and includes a surface pattern comprising a linear depression 23 separating two linear raised formations 21, 22.

Referring to FIG. 2B of the accompanying drawings, a second substrate 24 used in Example 1 is a block of MDF which is rectangular in form and includes a curved surface depression 25.

The first substrate 20, shown in FIG. 2A, had a higher moisture content and, consequently, higher electrical conductivity than the second substrate 24, shown in FIG. 2B.

The dimensions of the substrates range as follows:

Width=7 to 11 cm

Length=5 to 15 cm.

Depth=1.5 to 2.5 cm.

Two powder coating systems designated A and B were used in Example 1, both made up by the same formulation and differing in particle size distribution (PSD) and the manner of preparation. The powder coating systems were prepared by conventional powder coating milling.

The formulation common to the systems is given below:

| | Parts by weight |
|---|---|
| Rutile Titanium Dioxide | 321 |
| Filler (dolomite) | 107 |
| Carboxylic Acid-Functional Polyester Resin | 374 |
| Epoxy Resin Curing Agent | 152 |
| Catalyst | 30 |
| Wax | 3 |
| Flow modifier | 10 |
| Benzoin | 3 |
| TOTAL | 1000 |

In addition, the following additive formulation for post-blending was prepared:

Additive Formulation 1

Aluminium Oxide (Degussa Aluminium Oxide C)—45 parts by weight

Aluminium Hydroxide (Martinal OL107C)—55 parts by weight

Below are reported the particle size distributions (PSDs) of the two powder coating systems:

| | |
|---|---|
| **System A** | |
| $d(v)_{99}$, μm | 96.26 |
| $d(v)_{50}$, μm | 37.69 |
| % <10 μm | 4.33 |
| % <5 μm | 1.34 |
| **System B** | |
| $d(v)_{99}$, μm | 54.18 |
| $d(v)_{50}$, μm | 20.77 |
| % <10 μm | 16.83 |
| % <5 μm | 4.96 |

The general operating conditions were as follows:

| | |
|---|---|
| Weight of the powder loaded in the bed | 800 g |
| Free fluidisation time for equilibrating the bed: | 30 min. at 3 bar |
| Standard bake of deposited material | 30 min. at 120° C. |

The substrates were dipped in the powder coating compositions which included 0.6% of additive 1. The results obtained are summarised in the following table:

| Coating System | Type of Board | Panel Connection | Applied Voltage, KV | Dip-Time, sec | Potential Gradient, KV/cm | Coverage, % | Thickness, μm | STDEV |
|---|---|---|---|---|---|---|---|---|
| A | FIG. 2A | Earthed | +5 | 60 | 2.5 | 100 | 45 | 10 |
| A | FIG. 2A | Earthed | +5 | 180 | 2.5 | 100 | 155 | 10 |

-continued

| Coating System | Type of Board | Panel Connection | Applied Voltage, KV | Dip-Time, sec | Potential Gradient, KV/cm | Coverage, % | Thickness, μm | STDEV |
|---|---|---|---|---|---|---|---|---|
| A | FIG. 2A | Earthed | +10 | 180 | 5 | 100 | 235 | 30 |
| B | FIG. 2A | Earthed | +5 | 60 | 2.5 | 100 | 17.5 | 5 |
| B | FIG. 2A | Earthed | +5 | 180 | 2.5 | 100 | 23 | 8 |
| B | FIG. 2B | Earthed | +10 | 180 | 5 | 100 | 45 | 11 |

The abbreviation STDEV used in the above Table is the standard deviation of the film thickness measurements carried out on the faces of the substrate.

It is evident from the above results that both the System A and System B powders provided a full coating under similar conditions although the System A coating was generally thicker than the System B coating under similar conditions.

EXAMPLE 2

The substrate used in Example 2 is available under the name CONAMIDE R6 (produced by Polypenco Korea Co. Ltd.) and is a cast polyamide exhibiting some conductivity. The substrate had the form of a rectangular slab of the following dimensions:

Width=77 mm

Length=116 mm

Depth=10 mm

The powder coating system used in Example 2 was the same as the System B powder used in Example 1.

The formulation was the same as is used in Example 1 with 0.6% of additive 1.

The general operating conditions were as follows:

| | |
|---|---|
| Weight of the powder loaded in the bed: | 750 g |
| Free fluidisation time for equilibrating the bed: | 30 min at 3 bar |
| Standard bake of deposited material | 30 min. at 120° C. |

The results obtained are summarised in the following table:

| Coating System | Panel Connection | Applied Voltage, volts | Dip-time, Sec | Potential Gradient, kV/cm | Coverage, % | Thickness, μm | STDEV |
|---|---|---|---|---|---|---|---|
| B | Earthed | +1000 | 10 | 0.26 | 100 | 145 | 16.2 |
| B | Isolated | +1000 | 60 | 0.26 | 100 | 46 | 12.0 |
| B | Earthed | +650 | 10 | 0.17 | 100 | 118 | 14.3 |
| B | Earthed | +650 | 30 | 0.17 | 100 | 204 | 17.2 |
| B | Earthed | +150 | 20 | 0.04 | 100 | 72 | 15.2 |

The values reported in the "thickness" column are the average value of 12 film thickness measurements performed for each substrate. Each panel was measured at 6 different points on each face.

STDEV is the standard deviation of the film thickness measurements.

The substrate can be either electrically earthed or electrically isolated. The substrate exhibited moderate electrical conductivity and the process was more effective when the substrate was earthed rather than when electrically isolated.

The polarity and the magnitude of the applied voltage influence the performance (speed of coating process and uniformity and evenness film pattern thickness) of the powder coating system used. The powder coating system has a set of process conditions (applied voltage, dip-time, air-pressure) for the best performance.

EXAMPLE 3

Referring to FIGS. 3A and 3B of the accompanying drawings, the substrate used in Example 3 was a section of a motor vehicle wheel cap, FIG. 3A showing the front face of the section and FIG. 3B showing the back face of the section. The wheel cap had a diameter of 7.7 cm. and the section used was about a quarter of the wheel cap. The material in which the wheel cap was fabricated is available under the name Polyamide 66 and exhibits measurable, but significantly poor, electrical conductivity.

Referring to FIG. 3A, the substrate 30 had the form of a quadrant of a disc bearing edge formations 31 and inner formations 32 extending across its front surface in addition to isolated depressions 33 and 34 on its front surface.

Referring to FIG. 3B, the substrate 30, having the form of a quadrant of a disc, bore edge formations 36 and inner formations 37 extending across its back surface and, in addition, isolated depressions 40 and 41 and isolated projections 38 and 39 on its back surface.

Only one powder coating system was used in Example 3 and was the System B powder used in Examples 1 and 2.

The general operating conditions were as follows:

| | |
|---|---|
| Weight of the powder loaded in the bed: | 750 g |
| Free fluidisation time for equilibrating the bed: | 30 min at 3 bar |
| Standard bake and cure of deposited material | 30 min. at 120° C. |

The results obtained are summarised in the following Table:

| Voltage | Gradient | Dip time | Panel connection | Coverage | Deposited mass | Evenness 0-5 |
|---|---|---|---|---|---|---|
| +5 kV | 0.67 kV/cm | 80 secs | Earthed | 55% | 0.5 grams | 4 |

The substrate was of a relatively complex form including a plurality of curved and recessed areas, making film thickness measurement difficult. A measurement of the Deposited Mass was used as a measure of the film thickness built up.

The coverage was assessed visually.

The evenness of the film thickness pattern was assessed visually, the value:0 indicating very bad and the value 5 indicating very good.

Better results were obtained when the substrate was earthed than when it was electrically isolated.

In the case of Example 3, it was found that the coverage was enhanced by heating the substrate to a temperature T ° C. which lay below the melting point of the plastics substrate material and the transition point ($T_g$ ° C.) of the powder composition prior to dipping. The temperature of the substrate at the moment of the dipping was less than $T_g$ ° C. in order that the powder would adhere to the substrate only by a electrostatic process and not by a kind of sintering process. The heating process was carried out in an air-circulating oven.

The results obtained through heating of the substrate are summarised in the following Table:

| Oven Temp ° C. | Oven Time Mins | Voltage KV | Voltage Gradient KV/cm | Dip Time Secs | Panel Connection | Coverage % | Deposited mass grams | Evenness 0 to 5 |
|---|---|---|---|---|---|---|---|---|
| 40 | 10 | +1 | 0.13 | 30 | Earthed | 70 | 0.6 | 4 |
| 50 | 5 | +3 | 0.40 | 30 | Earthed | 80 | 0.9 | 4 |
| 40 | 5 | +3 | 0.40 | 60 | Earthed | 90 | 1.0 | 4 |
| 50 | 10 | +3 | 0.40 | 30 | Earthed | 100 | 2.1 | 5 |
| 40 | 5 | +5 | 0.67 | 15 | Earthed | 100 | 2.4 | 5 |
| 40 | 15 | +5 | 0.67 | 15 | Earthed | 100 | 3.1 | 3 |
| 40 | 5 | +5 | 0.67 | 15 | Isolated | 80 | 1.1 | 4 |
| 40 | 5 | +8 | 1.07 | 15 | Earthed | 100 | 3.6 | 3 |

EXAMPLE 4

The substrate used in Example 4 was a transparent polycarbonate (non-filled) rectangular panel of 47 mm×101 mm.

Only one powder System was used in Example 4. It was the System B powder used in Examples 1, 2 and 3.

The general operating conditions were as follows:

| | |
|---|---|
| Weight of the powder loaded in the bed: | 750 g |
| Free fluidisation time for equilibrating the bed: | 30 min at 3 bar |
| Standard bake and cure of deposited material | 30 min. at 120° C. |

Coating of the substrate was achieved. The uniformity of the coating was improved by heating the plastics material to a temperature below its melting point and below the transition point of the powder coating composition before immersion.

Further improvement was obtained on pre-charging the substrate before immersion and still further improvement was obtained by equalising the charge on the substrate before immersion. Charge equalisation was achieved either by heating the substrate to a temperature below its melting point or moistening the surface of the substrate.

EXAMPLE 5

The substrate used in Example 5 was a rectangular block of MDF board of dimensions 10 cm×15 cm×18 mm.

The formulation given above in relation to a System A powder was used, but was milled to a smaller particle size distribution as follows, this being identified as a System E powder:

| System E | |
|---|---|
| $d(v)_{99}$, μm | 10 |
| $d(v)_{50}$, μm | 5.5 |
| % <5 μm | 42 |

In addition, the following additive formulation, for post-blending, was prepared:

Additive formulation 2

Aluminium Oxide—15 parts by weight

Aluminium Hydroxide—45 parts by weight

Silica (Wacker HDK H3004)—40 parts by weight

Silica HDK H3004 is a hydrophobic silica available from Wacker-Chemie. The term hydrophobic silica denotes a silica of which the surface has been modified by the introduction of silyl groups, for example, polydimethylsiloxane, bonded to the surface.

The general operating conditions were as follows:

Weight of the powder in the fluidised bed—500 g

Free fluidisation time for equilibrating the bed—30 min at 3 bar

Fluidisation pressure during coating—3 bar

Standard bake of deposited material—30 min at 120° C.

Two MDF boards were dipped in 500 g of the System E powder with 2% of additive 1 and 2% of additive 2, respectively. The dipping time was 60 seconds in each case, 3 kV was applied to the fluidising chamber and the panels were heated at 120° C. for 30 minutes. The results are set out below and show that the System E powder with additive 1 post-blended has a relatively poor coating performance whereas, when additive 2 is used post-blended, the coating performance is considerably improved.

| Post additive | Potential Gradient | Coverage | Film thickness |
|---|---|---|---|
| Additive 1 | 1.2 kV/cm | 30% | 9 μm |
| Additive 2 | 1.2 kV/cm | 100% | 41 μm |

EXAMPLE 6

The substrate used in Example 6 was a CONAMIDE R6 plastics slab details of which are set out in Example 2 above. The general operating conditions were as for Example 5 above.

Two CONAMIDE R6 slabs were dipped in 500 g of the System E powder with 2% of additive 1 and 2% of additive 2, respectively. The dipping time was 60 seconds in each case, 3 kV was applied to the fluidising chamber and the slabs were heated at 120° C. for 30 minutes. The results are set out below and show that the System E powder with additive 1 post-blended has a relatively poor coating performance whereas, when additive 2 is used post-blended, the coating performance is considerably improved.

| Post additive | Potential Gradient | Coverage | Film thickness |
|---|---|---|---|
| Additive 1 | 1.2 kV/cm | 80% | 38 μm |
| Additive 2 | 1.2 kV/cm | 100% | 67 μm |

EXAMPLE 7

The substrate used in Example 7 was MDF board as for Example 5 above.

A second powder formulation and a third additive formulation for post blending, as set out below, were prepared.

| Powder Formulation 2 | Parts by weight |
|---|---|
| Titanium dioxide | 252 |
| Filler (Dolomite) | 161 |
| Carboxylic acid functional Polyester Resin | 400 |
| Epoxy Resin | 147 |
| Catalyst | 24 |
| Wax | 3 |
| Benzoin | 3 |
| Flow Modifier | 10 |

Additive Formulation 3

Aluminium Oxide—40 parts by weight

Aluminium Hydroxide—48 parts by weight

PTFE modified wax—12 parts by weight

The above Powder Formulation 2 was used and the particle size distribution was as for a System A powder used in Example 1 above. The general operating conditions were as for Example 5 above.

Two MDF boards were dipped in 500 g of the Formulation 2 System A powder with 0.6% of additive 1 and 0.6% of additive 3, respectively. The dipping time was 60 seconds in each case, 3 kV was applied to the fluidising chamber and the panels were heated at 120° C. for 30 minutes. The results are set out below and show that the coating performance can be radically improved for a particular substrate by careful selection of the post-blended additive.

| Post additive | Potential Gradient | Coverage | Film thickness |
|---|---|---|---|
| Additive 1 | 1.2 kV/cm | 75% | 22 μm |
| Additive 3 | 1.2 kV/cm | 100% | 44 μm |

EXAMPLE 8

The substrate used in Example 8 was a CONAMIDE R6 plastics slab details of which are set out in Example 2 above.

The general operating conditions were as for Example 5 above.

Two CONAMIDE R6 slabs were dipped in 500 g of the Formulation 2 System A powder with 0.6% of post-blended additive 1 and 0.6% of post-blended additive 3, respectively. The dipping time was 60 seconds in each case, 3 kV was applied to the fluidising chamber and the slabs were heated at 120° C. for 30 minutes. The results are set out below and show that the improved coating performance can be maintained, even when the substrate changes, by careful selection of the post-blended additive.

| Post additive | Potential Gradient | Coverage | Film thickness |
|---|---|---|---|
| Additive 1 | 1.2 kV/cm | 100% | 58 μm |
| Additive 3 | 1.2 kV/cm | 100% | 191 μm |

EXAMPLE 9

The substrate used in Example 9 was MDF board as in Example 5 above.

A Low-Bake and Cure powder formulation as set out below, was prepared.

| Low-Bake and Cure formulation | Parts by weight |
|---|---|
| Epoxy Epikote 3003 (Resolution) | 516 |
| Hardener (DEH 82 Dow) | 172 |
| Pigment ($TiO_2$) | 302 |
| Flow modifier | 4 |
| Benzoin | 3 |
| Wax | 3 |

The Low-Bake and Cure formulation was milled to a System A particle size distribution:

The general operating conditions were as for Example 5 above.

The MDF board was dipped in 500 g of the low-bake and cure formulation powder system with 0.6% of additive 1. The dipping time was 60 seconds in each case, 3 kV was applied to the fluidising chamber and the panels were heated at 120° C. for 30 minutes. Bake and cure were achieved at 120° C. in the time normally required for bake alone. The results, which are set out below, show that good coating performance can also be obtained by using a low-bake and cure formulation in a powder System with a normal mean particle size.

| Post additive | Potential Gradient | Coverage | Film thickness |
|---|---|---|---|
| 0.6% additive 1 | 1.2 kV/cm | 100% | 137 μm |

The invention claimed is:

1. A process for forming a coating on a substrate, including the steps of:

establishing a fluidised-bed of a powder coating composition, thereby effecting tribostatic charging of the powder coating composition, the fluidised-bed including a fluidising chamber at least a part of which is conductive, applying a voltage to the conductive part of the fluidising chamber, immersing a substrate which is either electrically non-conductive or poorly conductive wholly or partly in the fluidised bed, whereby tribostatically charged particles of the powder coating composition adhere to the substrate, the substrate being either electrically isolated or earthed, withdrawing the substrate from the fluidised-bed and forming the adherent particles into a continuous coating over at least part of the substrate, the process being conducted without ionisation or corona effects in the fluidised bed.

2. A process as claimed in claim 1 wherein the substrate comprises a medium density fibreboard (MDF).

3. A process as claimed in claim 1, wherein the substrate comprises wood.

4. A process as claimed in claim 1, wherein the substrate comprises a wood product.

5. A process as claimed in claim 1, wherein the substrate comprises a plastics material.

6. A process as claimed in claim 1, wherein the substrate comprises a plastics material including an electrically conductive additive.

7. A process as claimed in claim 6, wherein the plastics material comprises polyamide.

8. A process as claimed in claim 1, wherein the substrate comprises an insulating plastics material.

9. A process as claimed in claim 8, wherein the plastics material comprises polycarbonate.

10. A process as claimed in claim 1, wherein the surface resistance of the substrate is of the order of at least $10^3$ ohms/square.

11. A process as claimed in claim 1, wherein the surface resistance of the substrate is of the order of from $10^3$ to $10^5$ ohms/square.

12. A process as claimed in claim 1, wherein the surface resistance of the substrate is of the order of at least $10^5$ ohms/square.

13. A process as claimed in claim 1, wherein the surface resistance of the substrate is of the order of from $10^5$ to $10^{11}$ ohms/square.

14. A process as claimed in claim 1, wherein the surface resistance of the substrate is of the order of at least $10^{11}$ ohms/square.

15. A process as claimed in claim 5 including the step of heating the plastics material to a temperature below its melting point and below the transition point of the powder coating composition before immersing the substrate in the fluidised bed.

16. A process as claimed in claim 8, including the step of pre-charging the substrate before immersing it in the fluidised bed.

17. A process as claimed in claim 16, including the step of equalising the charge on the substrate before immersing the substrate in the fluidised bed.

18. A process as claimed in claim 17, including the step of heating the substrate to a temperature below its melting point in order to equalise the charge.

19. A process as claimed in claim 17, including the step of moistening the surface of the substrate in order to equalise the charge.

20. A process as claimed in claim 1, wherein there is no preheating of the substrate prior to immersion in the fluidised bed.

21. A process as claimed in claim 1, wherein a DC voltage is applied.

22. A process as claimed in claim 21, wherein a positive DC voltage is applied.

23. A process as claimed in claim 21, wherein a negative DC voltage is applied.

24. A process as claimed in claim 1, wherein the voltage is applied such that the maximum potential gradient existing in the fluidised bed is 29 kV/cm, 27.5, 25, 20, 15, 10, 5, 1 or 0.05 kV/cm.

25. A process as claimed in claim 1, wherein the voltage is applied such that the potential gradient existing in the fluidised bed is at least 0.1 kV/cm.

26. A process as claimed in claim 1, wherein the voltage is applied such that the potential gradient existing in the fluidised bed is at least 0.5 kV/cm.

27. A process as claimed in claim 1, wherein a voltage in the range of from 10V to 100 kV is applied.

28. A process as claimed in claim 27, wherein a voltage in the range of from 100 V to 60 kV is applied.

29. A process as claimed in claim 27, wherein a voltage in the range of from 100 V to 30 kV is applied.

30. A process as claimed in claim 27, wherein a voltage in the range of from 100 V to 10 kV is applied.

31. A process as claimed in claim 1, wherein a substrate comprising a non-metal is immersed.

32. A process as claimed in claim 1, wherein the substrate is immersed with the fluidising chamber in a charged condition for a period of up to 30 minutes.

33. A process as claimed in claim 1, wherein the substrate is immersed with the fluidising chamber in a charged condition for a period of at least 10 milliseconds.

34. A process as claimed in claim 1, wherein a coating of thickness of up to 500 microns is applied.

35. A process as claimed in claim 1, wherein a coating of thickness of at least 5 microns is applied.

36. A process as claimed in claim 35, wherein a coating of thickness in the range of from 20 to 60 microns is applied.

37. A process as claimed in claim 1, including shaking or vibrating the substrate to remove loose particles.

38. A process as claimed in claim 1, wherein the powder coating composition is a thermosetting system.

39. A process as claimed in claim 38, wherein the powder coating composition comprises a film-forming polymer selected from one or more of carboxy-functional polyester resins, hydroxy-functional polyester resins, epoxy resins and functional acrylic resins.

40. A process as claimed in claim 1, wherein the powder coating composition is a thermoplastic system.

41. A process as claimed in claim 1, wherein the powder coating composition incorporates, by post-blending, one or more fluidity-assisting additives.

42. A process as claimed in claim 41, wherein the powder coating composition incorporates a combination of alumina and aluminium hydroxide as a fluidity-assisting additive.

43. A process as claimed in claim 42, wherein the fluidity-assisting additive includes hydrophobic silica.

44. A process as claimed in claim 42, wherein the fluidity-assisting additive includes a PTFE modified wax.

45. A process as claimed in claim 1, wherein substantially all of the powder particles are no larger than 10 μm.

46. A process as claimed in claim 1, wherein the substrate is wholly immersed within the fluidised bed.

47. A process as claimed in claim 6, including the step of heating the plastics material to a temperature below its melting point and below the transition point of the powder coating composition before immersing the substrate in the fluidised bed.

* * * * *